US006748606B1

(12) United States Patent
Silverstein

(10) Patent No.: US 6,748,606 B1
(45) Date of Patent: Jun. 15, 2004

(54) SIZE ADJUSTABLE HAT INCLUDING A REMOVABLE SWEATBAND

(75) Inventor: Richard Silverstein, Fall River, MA (US)

(73) Assignee: Korber Hats, Inc., Fall River, MA (US)

( * ) Notice: Subject to any disclaimer, the term of this patent is extended or adjusted under 35 U.S.C. 154(b) by 183 days.

(21) Appl. No.: 10/196,979

(22) Filed: Jul. 17, 2002

(51) Int. Cl.[7] ..... A42B 1/22
(52) U.S. Cl. ..... 2/183; 2/181.4
(58) Field of Search ..... 2/181, 181.2, 181.4, 2/181.6, 183

(56) References Cited

U.S. PATENT DOCUMENTS

| | | | | |
|---|---|---|---|---|
| 1,894,213 A | | 1/1933 | Ostolaza | |
| 2,040,355 A | | 5/1936 | Wittcoff | |
| 4,011,600 A | | 3/1977 | Malk | |
| 4,642,817 A | | 2/1987 | Ferstenfeld | |
| 5,402,538 A | * | 4/1995 | Conrad | 2/195.2 |
| 5,426,789 A | | 6/1995 | MacLeod | |
| 5,548,845 A | | 8/1996 | Gallup | |
| 6,049,911 A | | 4/2000 | Bromberg | |

* cited by examiner

*Primary Examiner*—Katherine Moran
(74) *Attorney, Agent, or Firm*—Salter & Michaelson

(57) ABSTRACT

A hat having an adjustable inner circumference is provided. The hat includes a primary sweatband and an adjustable secondary sweatband which is removably secured at both of its opposing first and second ends to the primary sweatband. The opposing ends of the secondary sweatband are received within a pair of corresponding openings formed in the primary sweatband such that the ends of the secondary sweatband lie between the interior surface of the primary sweatband and the interior margin of the hat. Fastening members are positioned on both the opposing ends of the secondary sweatband and on the inner surface of the primary sweatband, adjacent the pair of openings. The fastening members allow the position of the secondary sweatband to be varied along the length of the primary sweatband in order to adjust the inner circumference of the hat.

13 Claims, 4 Drawing Sheets

SIZE ADJUSTABLE HAT INCLUDING A REMOVABLE SWEATBAND

TECHNICAL FIELD

The invention relates generally to a size adjustable hat and, more particularly, to a size adjustable hat including a removable sweatband portion which allows the inner circumference of the hat to be adjusted and which aids in holding the hat on the head of a user.

BACKGROUND OF RELATED ART

Hats whose size are adjustable are well known, as are adjustable straps for hats. U.S. Pat. No. 5,426,789 to MacLeod discloses a size adjustable hat having an auxiliary sweatband which cooperates with the hat's main, fixed sweatband, for adjusting the size of the hat to the size of the head of the wearer. The main sweatband includes a pair of slit openings, which are spaced from each other in the rear of the hat and which receive part of the auxiliary sweatband therein. The MacLeod patent further discloses that the auxiliary sweatband is secured at the rear of the crown of the hat to the main sweatband by stitching disposed on the remote side of the first slit opening. The auxiliary sweatband, which has a smaller width than the main sweatband, extends from an inner surface of the main sweatband, through the first slit opening adjacent to the outer surface of the sweatband, and back through the second slit opening. The fixed end of the auxiliary sweatband does not move in the slit opening and is fixedly secured. In contrast, the free end (FIG. 3) of the auxiliary sweatband includes a piece of Velcro® which is mounted on both the inside surface of the auxiliary sweatband at one end thereof, and which has a co-operating member secured to the inner surface of the main sweatband. Thus, the sweatband disclosed in the MacLeod patent is adjustable only on one side thereof, along only the rear portion of the hat only.

U.S. Pat. No. 4,642,817 to Ferstenfeld discloses an adjustable sweatband for a hat including a sweatband which is discontinuous over a portion of the crown and which has overlapping sweatband extensions with fastening means for adjusting the size of the hat. More specifically, the Ferstenfeld patent discloses a sweatband which is secured along its lower margin by stitching to the lower part of the crown of the hat. The sweatband includes first and second extensions which overlap with each other, and which are provided witil a fastening device such as Velcro®. A sweatband-free portion remains near the rear of the hat, the sweatband not being attached to the crown in the sweatband-free portion. In the sweatband-free portion a strip of relatively rigid plastic material is fixed and extends for the full length of the sweatband-free portion at the rear of the hat. The sweatband is sewn through the rigid strip in order to provide a pivot means for the first and second extensions, as shown in the figures of the patent. When the hat is worn, the firs. and second extensions are adjusted to.the size of the head of the person and are fixed in the adjusted position by the Velcro® fastening device.

U.S. Pat. No. 4,011,600 to Malk discloses a hat having an adjustable sweatband in order to control the tightness and fit of the hat. The sweatband is secured along its lower edge by stitching to the interior of the crown of the hat. A draw band is stitched at one end to the crown facing side of the sweatband, and extends circumferentially around the sweatband, preferably over the majority of the circumference of the band. The draw strip is slidably confined in position against the inner side of the sweatband by an elongate retaining strip, which is stitched to the inner side of the sweatband above and below the draw band so as to loosely hold draw band in position. The free or unsecured end of draw strip projects freely beyond the open end of the retaining strip. Mating pads of Velcro® material are stitched to the free end of the draw band, and to the inner side of the sweatband at a location between the opposite ends of the retaining strip (FIGS. 5 and 6). The Velcro® pads enable the free end of the draw band to be detachably secured at selected positions of circumferential adjustment relative to the sweatband, so as to selectively adjust the size of the hat.

Although the aforementioned devices for adjusting the size of a hat have met with some success, there remains a need in the art for an adjustable hat which can effectively assist in maintaining the hat on the head of the user, which is readily adjustable over a range of sizes to fit heads of varying circumference, and which may be replaced.

SUMMARY

It is an object of the adjustable hat disclosed herein to provide a hat whose size can be readily adjusted, which is easy to use and replace, and which may aid in preventing the hat from blowing off the head of the user. A size adjustable hat including a removable sweatband portion which allows the inner circumference of the hat to be adjusted and which aids in holding the hat on the head of a user is disclosed herein. The hat includes a primary sweatband which extends and is secured along the inner circumference of the margin of the hat, disposed between the brim and the crown. An adjustable secondary sweatband portion is removably secured at both of its opposing first and second ends to the primary sweatband portion. The opposing ends of the secondary sweatband are received within a pair of corresponding openings formed in the primary sweatband, such that the ends of the secondary sweatband lie between the interior surface of the primary sweatband and the interior margin of the hat during use. Fastening members are positioned on both the opposing ends of the secondary sweatband and on the inner surface of the primary sweatband, adjacent the pair of openings. The fastening members allow the position of the secondary sweatband to be varied along the length of the primary sweatband, the fastening members matingly engaging each other during use in order to secure the adjustable secondary sweatband in the desired position. In one embodiment, the fastening members are mating pieces of Velcro® material. The secondary sweatband is disposed adjacent a front portion of the hat such that it contacts the forehead of the wearer and aids in preventing unwanted removal of the hat. The secondary sweatband is removable by the wearer so that it can be replaced, as needed.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
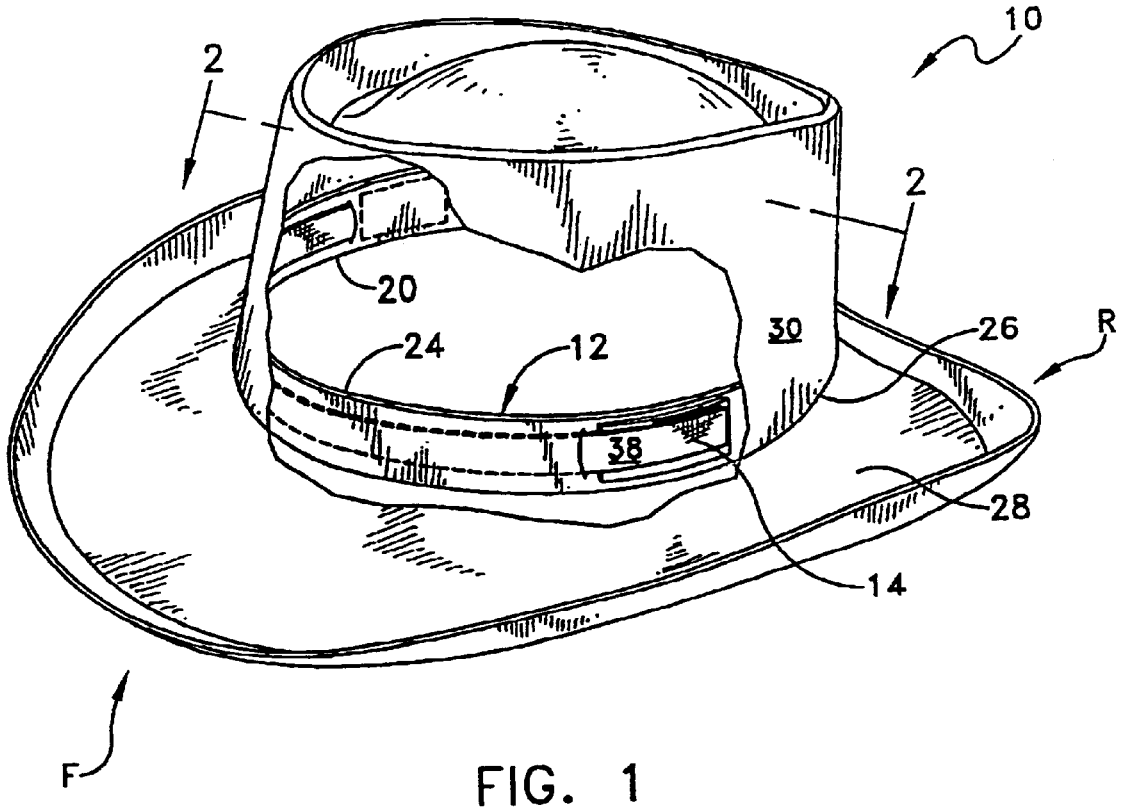
FIG. 1 is a perspective view of a hat including a removable and adjustable sweatband portion which allows the inner circumference of the hat to be adjusted by the wearer.
Figure 2:
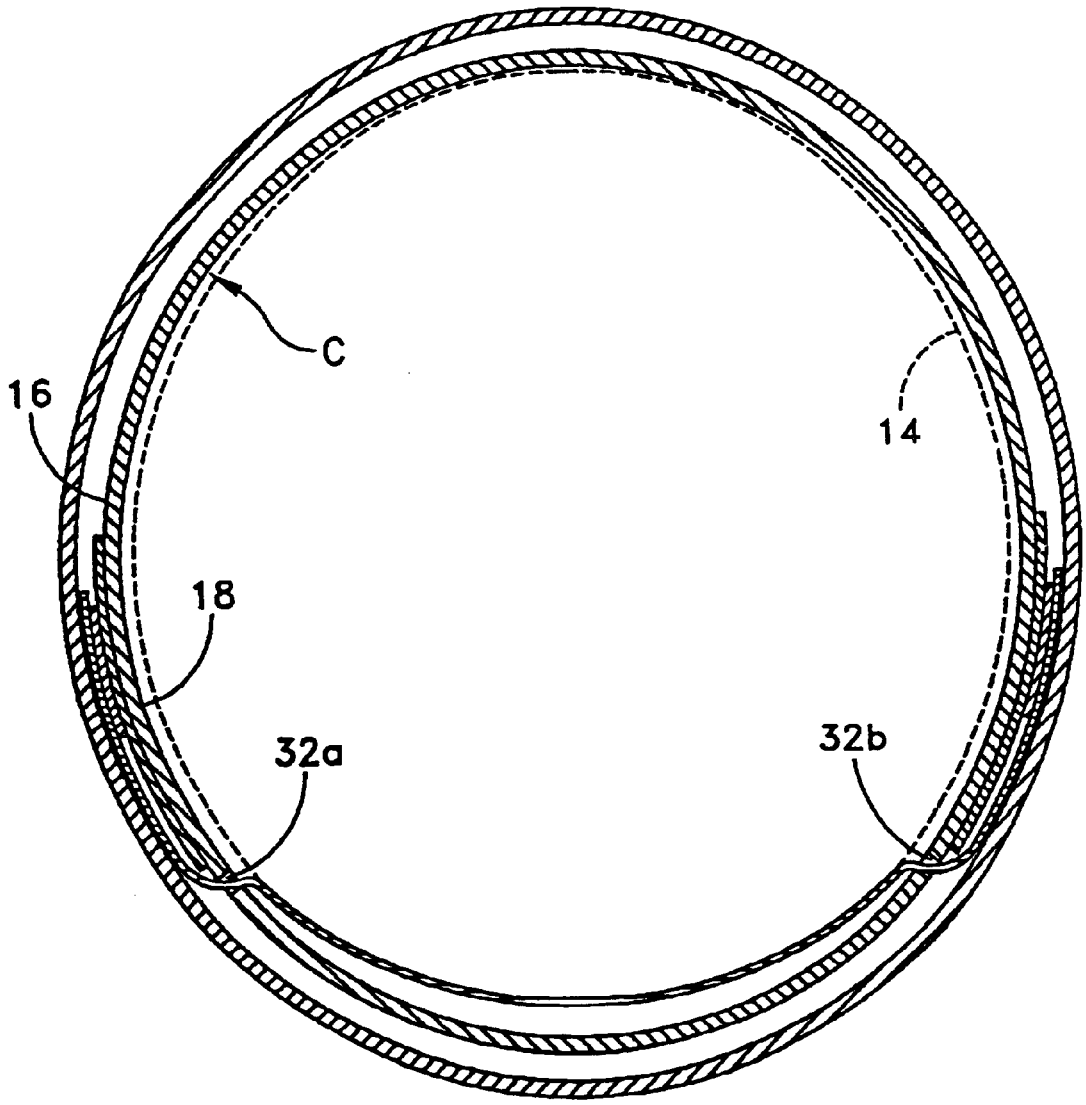
FIG. 2 is a cross sectional view of the hat of FIG. 1 taken along lines 2—2.

A size adjustable hat 10 including a primary sweatband 12 and an adjustable secondary sweatband 14 which is removably secured to the primary sweatband is illustrated in FIGS. 1–5. The adjustable secondary sweatband is provided in order to allow the wearer of the hat to selectively adjust the inner circumference of the hat to a proper fit for the size of the wearer's head. The hat includes a forward or front portion, "F", which extends from about ear to ear adjacent the forehead portion of the wearer's head, a rear or back portion "R", which extends from about ear to ear adjacent the rear portion or back of the wearer's head, a brim 28, and a crown 30, as is conventional. The primary sweatband 12 includes an inner surface 16, an outer surface 18, a lower edge 20 and an upper edge 24. At least the outer surface 18 of the primary sweatband is preferably made of a material which is designed to absorb perspiration. The inner surface 16 of the primary sweatband 12 is positioned adjacent the margin 26 of the hat, between the brim 28 and the crown 30, while the outer surface 18 lies adjacent the wearer's head during use. The primary sweatband 12 preferably extends around the entire inner circumference "C" at the margin 26 of the hat and is secured thereto. In the present embodiment, the primary sweatband is secured along its upper edge 24 to the margin, for example by stitching. Disposed through the primary sweatband at the front portion of the hat are a pair of opposing slits or openings 32*a , b*. The slits are preferably positioned in the primary sweatband so that they lie approximately on either side of the wearer's forehead during use.

Figure 3:
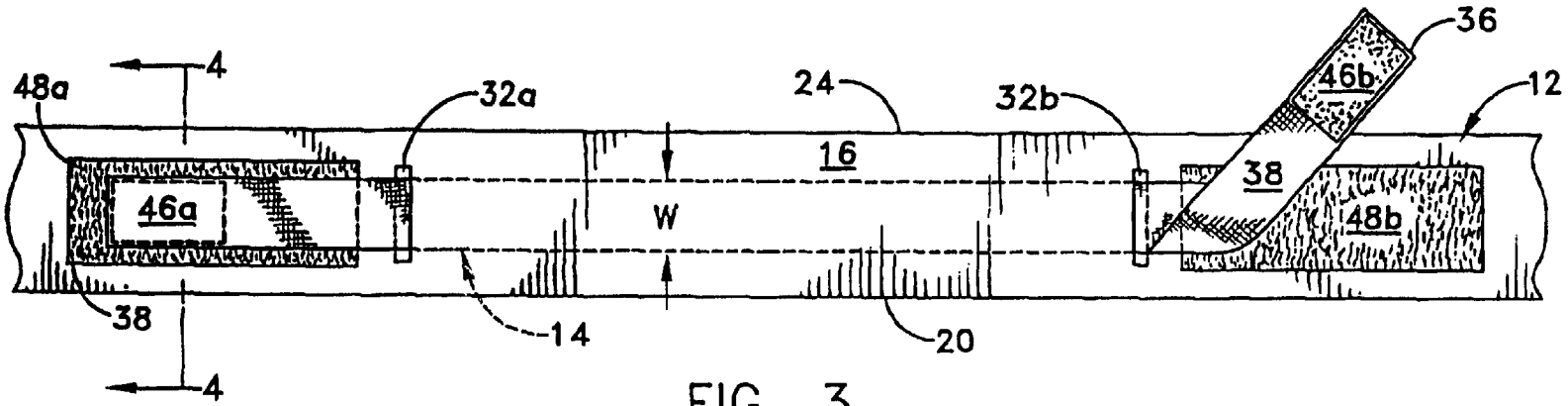
FIG. 3 is an enlarged view ofa portion of the primary sweatband and adjustable sweatband.
Figure 4:
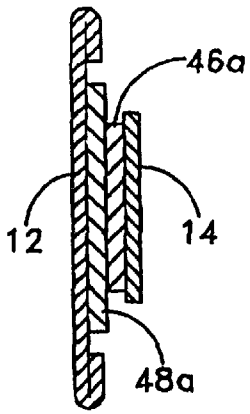
FIG. 4 is a cross sectional view of the sweatbands of FIG. 4 taken along lines 4—4.
Figure 5:
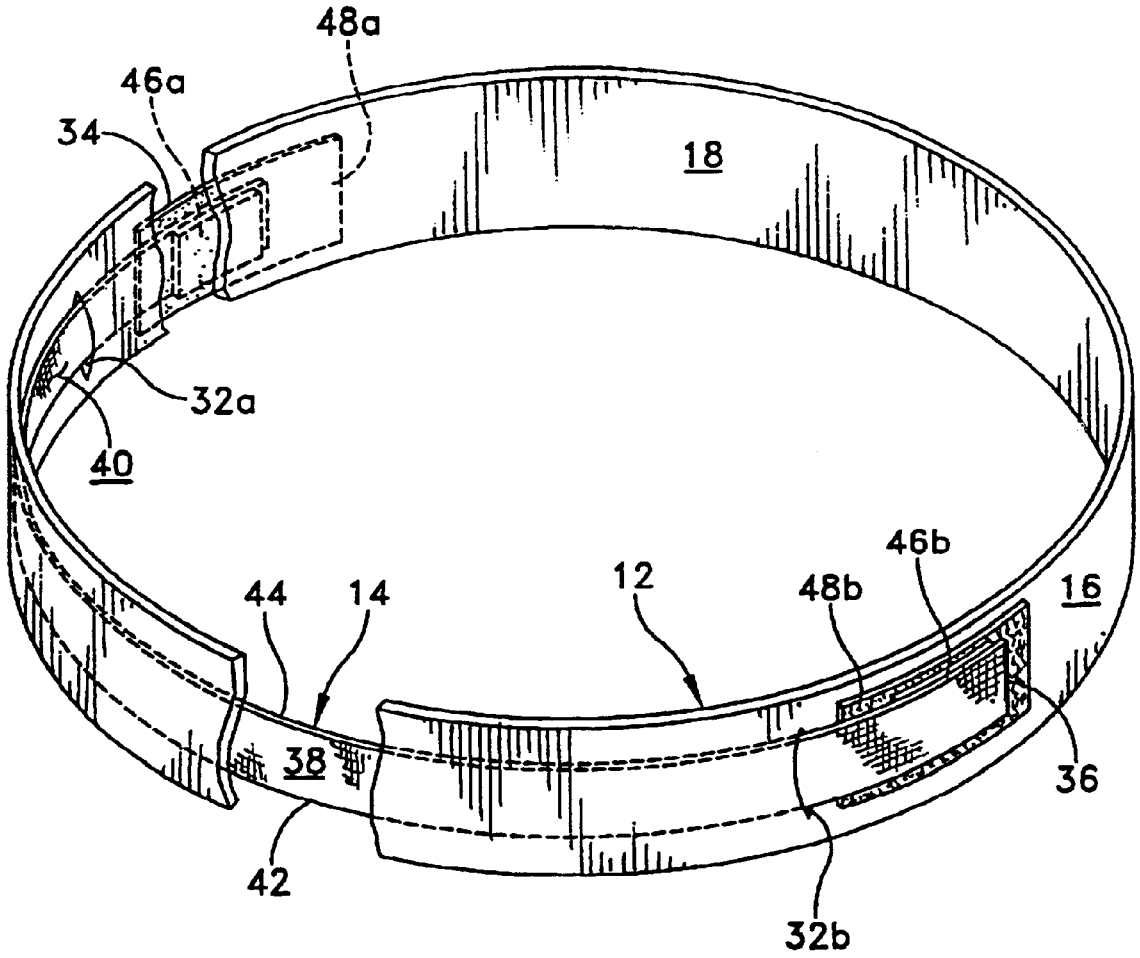
FIG. 5 is perspective view of the primary sweatband and adjustable sweatband of FIG. 1 during use.

Referring now to FIGS. 3–5, the adjustable secondary sweatband 14 includes a first end 34 and an opposing second end 36 both of which are removably secured along the front portion of the hat at a first end 34 and at an opposing second end 36 to the inner surface 16 of the primary sweatband 12. The secondary sweatband is preferably provided along the front portion of the hat, adjacent the wearer's forehead, in order to aid in securing the hat to the head of the wearer, for example when a gust of wind blows. The secondary sweatband is also preferably made of perspiration absorbent material and further includes an inner surface 38, an outer surface 40, a lower edge 42 and an upper edge 44. During use, the inner surface 38 of the secondary sweatband lies adjacent the outer surface 18 of the primary sweatband, while the outer surface 44 of the secondary sweatband lies adjacent the head "H" of the wearer. The width, "W", of the secondary sweatband 14 is preferably less than that of the openings 32*a*, 32*b* in the primary sweatband, such that the ends 34, 36 of the secondary sweatband can be easily positioned and moved within the openings 32*a*, 32*b* of the primary sweatband.

The first end 34 of the secondary sweatband is preferably received through corresponding opening 32*a*, while the second end 36 of the sweatband is received through corresponding opening 32*b* during use. Supported on the outer surface of the secondary sweatband adjacent each of the first and second ends 34, 36 are fastening member 46*a*, 46*b*. Corresponding fastening members 48*a*, 48*b* are supported on the inner surface of the primary sweatband, adjacent and rearward of each of the openings 32*a*, 32*b*. The fastening members 48*a*, 48*b* are designed to matingly and releasably engage fastening members 46*a*, 46*b*. The fastening members allow the position of the secondary sweatband to be varied along the length of the primary sweatband, the fastening members matingly engaging each other during use in order to secure the adjustable secondary sweatband in the desired position. In the present embodiment, the fastening members are mating pieces of Velcro® loop and hook material secured to the inner surface of the primary sweatband and the outer surface of the secondary sweatband. The length of the Velcro® material effects the range of adjustability for the secondary sweatband. Thus, the longer the strips of Velcro® material, the greater the adjustability. Although the length of the Velcro® material may be readily varied, in the present embodiment it is preferred that the length not extend beyond the approximate position of a wearer's ears, i.e., the Velcro® material preferably extends only along the forward or front portion of the hat. The Velcro® loop and mating hook material may be of similar or dissimilar lengths. Only one of the loop and hook material need be of sufficient length to allow for a range of adjustability. Alternately, other adjustable fastening devices may be utilized as would be known to those of skill in the art.

Use of the adjustable hat will now be described with reference to the Figures. In use, the first and second ends of the secondary sweatband are inserted through the corresponding openings in the primary sweatband. The wearer can then adjust either or both ends of the secondary strap relative to the primary sweatband until a proper and comfortable fit is achieved. If the wearer desires to tighten the hat, the first and/or second ends of the secondary strap are inserted further into the openings, i.e. rearwardly, adjacent to the inner surface of the primary sweatband, thereby effectively reducing the inner circumference "C" of the hat. If the hat is too tight on the head of the wearer, then the secondary strap is pulled from within the openings, thus lengthening the portion of the secondary sweatband which contacts the wearer's head. As will be appreciated, the adjustment of the inner circumference can be no greater than that of the length of secondary sweatband. The secondary sweatband should be snug, but not uncomfortably tight, so that it aids in keeping the hat on the head of the user without undue discomfort. As will be appreciated, because it is not attached along its entire length, the secondary sweatband can more readily conform to the forehead of the user than the primary sweatband. This, along with the snug fit, can help keep the hat on the head of the user, for example during a gust of wind. Once a satisfactory fit is achieved, the first and second ends of the secondary sweatband are removably secured to the inner surface of the primary sweatband, for example by Velcro® material. After use, the secondary sweatband can be removed, for example, to be washed or replaced, as desired. Thus, the adjustable hat of the present disclosure can be readily adjusted, is easy to use, and may aid in preventing the hat from blowing off the head of the wearer.

It will be understood that various modifications may be made to the embodiment disclosed herein. For example, although Velcro® material is disclosed, other fasteners positioned to adjust the secondary sweatband relative to the primary sweatband may be utilized, as would be known to those of skill in the art. In addition, materials, sizes, securing methods, and the like may be varied as would be known to those of skill in the art. Therefore, the above description should not be construed as limiting, but merely as exemplifications of a preferred embodiment. Those skilled in the art will envision other modifications within the scope, spirit and intent of the invention.

What is claimed is:

1. An adjustable hat having a front portion, a back portion, a brim and a crown, the adjustable hat further comprising:

an interior margin disposed between the brim and the crown;

a primary sweatband fixedly secured adjacent the interior margin and including an inner surface disposed adjacent the interior margin and an opposing outer surface;

a first opening and a second opening disposed through the primary sweatband adjacent the front portion of the hat and spaced a predetermined distance from each other;

a secondary sweatband having a first end, an opposing second end, an inner surface, an outer surface and being sized to fit within the first and second openings;

a first pair of fastening members, one of the first pair of fastening members supported on the first end of the secondary sweatband, and the other of the first pair of fastening members supported on the second end of the secondary sweatband;

a second pair of fastening members, one of the second pair of fastening members supported on the inner surface of the primary sweatband, the other of the second pair of fastening members supported on the inner surface of the primary sweatband, the second pair of fastening members being constructed and arranged to matingly engage corresponding members of the first pair of fastening members; and wherein the secondary sweatband is removable from engagement with the primary sweatband so that the sweatband can be replaced, and wherein the secondary sweatband has a length which extends only adjacent about the front portion of the hat so as to aid in adjusting the fit of the hat to maintain the hat on the head of the wearer.

2. The hat of claim 1, wherein the first and second pairs of fastening members comprise hook and loop material.

3. The hat of claim 1, wherein the primary sweatband is made from an absorbent material.

4. The hat of claim 1, wherein the second pair of fastening members each having a length greater than a length of the corresponding first pair of fastening members.

5. The hat of claim 1, wherein the first and second ends of the secondary sweatband are removably secured to the inner surface of the primary sweatband.

6. The hat of claim 1, wherein the second pair of fastening members are each positioned rearward of the respective first and second openings.

7. In an adjustable hat having a front portion, a back portion, a brim, a crown, an interior margin disposed between the brim and the crown, and a primary sweatband fixedly secured to the interior margin and including an inner surface disposed adjacent the interior margin and an opposing outer surface, the improvement comprising:

a first opening and a second opening disposed through the primary sweatband adjacent the front portion of the hat and spaced a predetermined distance from each other;

a secondary sweatband having a first end, a second end, an inner surface, and an outer surface, the first end of the secondary sweatband being receivable through the first opening and removably secured to the inner surface of the primary sweatband and the second end of the secondary sweatband being receivable through the second opening and removably secured to the inner surface of the secondary sweatband such that the secondary sweatband lies adjacent the front portion of the hat so as to aid in adjusting the fit of the hat and to maintain the hat on the head of a wearer.

8. The improvement of claim 7, further comprising a first pair of fastening members, one of the first pair of fastening members supported on the first end of the secondary sweatband, the other of the first pair of fastening members supported on the second end of the secondary sweatband, and a second pair of fastening members, one of the second pair of fastening supported on the inner surface of the primary sweatband rearward of the first opening, the other of the second pair of fastening members supported on the inner surface of the primary sweatband rearward of the second opening, the second pair offastening members being constructed and arranged to matingly engage corresponding members of the first pair of fastening members.

9. The improvement of claim 8, wherein the first and second pairs of fastening members comprise hook and loop material.

10. The hat of claim 8, wherein the second pair of fastening members each having a length greater than a length of the corresponding first pair of fastening members.

11. The hat of claim 7, wherein the secondary sweatband is made from an absorbent material.

12. A method of adjusting the fit of a hat comprising the steps of:

providing a hat having a front portion, a back portion, a brim, a crown, an interior margin disposed between the brim and the crown, and a primary sweatband fixedly secured adjacent the interior margin, the primary sweatband including an inner surface disposed adjacent the interior margin, an opposing outer surface, and a first opening and a second opening disposed through the primary sweatband adjacent the front portion of the hat and spaced a predetermined distance from each other;

providing a secondary sweatband having a first end and an opposing second end;

inserting the first end of a secondary sweatband through the first opening in the primary sweatband;

adjusting the first end of the secondary sweatband relative to the first opening in the primary sweatband;

releasably securing the first end of the secondary sweatband to the inner surface of the primary sweatband adjacent the first opening;

inserting the second end of a secondary sweatband through the second opening in the primary sweatband;

adjusting the second end of the secondary sweatband relative to the second opening in the primary sweatband;

releasably securing the second end of the secondary sweatband to the inner surface of the primary sweatband adjacent the second opening.

13. The method of claim 12 further comprising the step of removing the first end and second end from engagement with the primary sweatband.

* * * * *